US010688353B2

(12) United States Patent
Norimura

(10) Patent No.: US 10,688,353 B2
(45) Date of Patent: Jun. 23, 2020

(54) IRON-TYPE GOLF CLUB HEAD

(71) Applicant: Dunlop Sports Co. Ltd., Kobe-shi, Hyogo (JP)

(72) Inventor: Takahiro Norimura, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 618 days.

(21) Appl. No.: 15/173,145

(22) Filed: Jun. 3, 2016

(65) Prior Publication Data

US 2016/0354650 A1 Dec. 8, 2016

(30) Foreign Application Priority Data

Jun. 4, 2015 (JP) ..... 2015-113660

(51) Int. Cl.
*A63B 53/04* (2015.01)

(52) U.S. Cl.
CPC .... *A63B 53/047* (2013.01); *A63B 2053/0408* (2013.01); *A63B 2053/0433* (2013.01); *A63B 2053/0491* (2013.01)

(58) Field of Classification Search
CPC ..... A63B 53/047; A63B 2053/0408; A63B 2053/0491; A63B 2053/0433; A63B 53/0475; A63B 53/06
See application file for complete search history.

(56) References Cited

U.S. PATENT DOCUMENTS 6,592,469 B2 * 7/2003 Gilbert ..... A63B 53/04 473/350
6,921,344 B2 * 7/2005 Gilbert ..... A63B 53/047 473/334
7,192,362 B2 * 3/2007 Gilbert ..... A63B 53/047 473/291
7,390,270 B2 * 6/2008 Roberts ..... A63B 53/047 473/332
7,815,523 B2 * 10/2010 Knutson ..... A63B 53/047 473/349
9,901,792 B2 * 2/2018 Franklin ..... A63B 53/04
(Continued)

FOREIGN PATENT DOCUMENTS

JP 9-253248 A 9/1997
JP 10-295861 A 11/1998
JP 2014-410 A 1/2014

*Primary Examiner* — William M Pierce
(74) *Attorney, Agent, or Firm* — Birch, Stewart, Kolasch & Birch, LLP

(57) ABSTRACT

An iron-type golf club head having a club face provide with a plurality of grooves extending in the toe-heel direction, satisfies the following conditions (1) the loft angle of the club head is not more than 41 degrees, (2) the thickness of the club head is not more than 23 mm, (3) the height of the club face measured along the club face at the position of the most toe-side end of the grooves is not less than 53 mm, (4) in a standard state of the club head set on a horizontal plane at the lie angle and loft angle specified for the club head, the ratio M/Sh (g sq·cm/mm) of a moment M of inertia (g sq·cm) around a first axis passing through a sweet spot in parallel with the club face and perpendicularly to the grooves, and a sweet spot height Sh (mm) which is the vertical height from the horizontal plane to the sweet spot is not less than 152.

5 Claims, 8 Drawing Sheets

(56) References Cited

U.S. PATENT DOCUMENTS 9,950,219 B2 * 4/2018 Larson ..... A63B 53/0466
10,004,957 B2 * 6/2018 Franz ..... A63B 53/047
10,046,211 B2 * 8/2018 Franklin ..... A63B 53/0487
2001/0001774 A1 * 5/2001 Antonious ..... A63B 53/04 473/349
2003/0078112 A1 * 4/2003 Sugimoto ..... A63B 53/04 473/342
2003/0181259 A1 * 9/2003 Shimazaki ..... A63B 53/047 473/350
2006/0234811 A1 * 10/2006 Gilbert ..... A63B 53/047 473/349
2007/0254749 A1 * 11/2007 Nakamura ..... A63B 53/047 473/349
2009/0221382 A1 * 9/2009 Soracco ..... A63B 53/047 473/291
2010/0137074 A1 * 6/2010 Gilbert ..... A63B 53/04 473/349
2010/0160076 A1 * 6/2010 Ling ..... A63B 53/047 473/350
2010/0261540 A1 * 10/2010 Roach ..... A63B 53/04 473/291
2010/0267463 A1 * 10/2010 Stites ..... A63B 53/047 473/291
2010/0304887 A1 * 12/2010 Bennett ..... A63B 53/0475 473/336
2011/0124432 A1 * 5/2011 Oldknow ..... A63B 53/047 473/334
2011/0207551 A1 * 8/2011 Breier ..... A63B 53/047 473/332
2011/0250985 A1 * 10/2011 Stites ..... A63B 53/047 473/332
2012/0122606 A1 * 5/2012 Yamamoto ..... A63B 53/047 473/332
2012/0289360 A1 * 11/2012 Breier ..... A63B 53/047 473/335
2012/0295729 A1 * 11/2012 Matsunaga ..... A63B 53/047 473/291
2013/0150178 A1 * 6/2013 Rollinson ..... A63B 53/0475 473/332
2013/0165257 A1 * 6/2013 Dipert ..... A63B 53/047 473/349
2013/0331201 A1 * 12/2013 Wahl ..... A63B 53/0475 473/329
2013/0344988 A1 * 12/2013 Hettinger ..... A63B 53/047 473/349
2014/0357400 A1 * 12/2014 Schweigert ..... A63B 60/00 473/324
2015/0024864 A1 * 1/2015 Jertson ..... A63B 53/047 473/291
2015/0126301 A1 * 5/2015 Taylor ..... A63B 53/047 473/324
2015/0165281 A1 * 6/2015 Ines ..... A63B 53/047 473/291
2015/0182816 A1 * 7/2015 Radcliffe ..... A63B 53/047 473/324
2015/0182817 A1 * 7/2015 Oldknow ..... A63B 53/047 473/324
2015/0231454 A1 * 8/2015 Parsons ..... A63B 53/0475 473/335
2015/0328508 A1 * 11/2015 Parsons ..... A63B 53/0475 473/350
2016/0038796 A1 * 2/2016 Taylor ..... A63B 53/047 473/349
2016/0158607 A1 * 6/2016 Parsons ..... A63B 53/0475 473/350
2016/0184665 A1 * 6/2016 Nakamura ..... A63B 53/047 473/335
2016/0193508 A1 * 7/2016 Issertell ..... A63B 53/047 473/342
2016/0243413 A1 * 8/2016 Ritchie ..... A63B 53/047
2016/0287955 A1 * 10/2016 Ritchie ..... A63B 53/047
2016/0296804 A1 * 10/2016 Parsons ..... A63B 53/04
2016/0354650 A1 * 12/2016 Norimura ..... A63B 53/047
2017/0216684 A1 * 8/2017 Parsons ..... A63B 53/047
2017/0246517 A1 * 8/2017 Ueda ..... A63B 53/047
2017/0252613 A1 * 9/2017 Daraskavich ..... A63B 53/047
2017/0259134 A1 * 9/2017 Ines ..... B21K 17/00
2017/0340928 A1 * 11/2017 Parsons ..... A63B 53/047
2018/0093144 A1 * 4/2018 Ripp ..... A63B 53/047
2018/0117425 A1 * 5/2018 Taylor ..... A63B 53/02
2018/0169488 A1 * 6/2018 Parsons ..... A63B 53/0475
2018/0189758 A1 * 7/2018 Beach ..... G06Q 20/18
2018/0221727 A1 * 8/2018 Parsons ..... A63B 53/0487
2018/0229089 A9 * 8/2018 Parsons ..... A63B 53/0475
2018/0256946 A1 * 9/2018 Stokke ..... A63B 53/04

* cited by examiner

IRON-TYPE GOLF CLUB HEAD

BACKGROUND OF THE INVENTION

The present invention relates to a golf club head, more particularly to an iron-type golf club head capable of improving the flying distance and directionality of a ball hit by an average golfer.

In general, an iron-type golf club head is designed such that, when a ball is hit at a suitable position such as the sweet spot or the center of the club face, the flying distance of the ball becomes maximum. However, it is difficult For the average golfers to hit a ball at such a suitable position every time. Therefore, in the case of the average golfers, there is a tendency that the flying distance varies wide.

In the circumstances described above, for example, in the Japanese Patent Application Publication Nos. H9-253248 and H10-295861, an iron-type golf club head in which the position of the center of gravity of the club head is lowered has been proposed. Such a club head accordingly has the sweet spot at a lower position on the club face.

In general, an iron-type golf club has many opportunities to hit a ball lying on lawn, therefore, the ball hitting position tends to become in a sole-side region of the club face. Accordingly, in the case of the above-mentioned club head, the actual ball hitting position tends to coincide with the sweet spot. This helps to improve the flying distance.

In the case of a golf club head whose center of gravity is further lowered, chances of hitting a ball on the upper side of the sweet spot become high.

If a ball is hit on the upper side of the sweet spot, the club head is rotated by a small angle so as to increase the loft angle, and the launch angle of the ball is increased accordingly. Thereby, due to the gear effect, the excessive backspin of the ball is prevented. Thus, in this respect too, the club head having the lowered center of gravity is advantageous to increasing the flying distance.

In recent years, on the other hand, an iron-type golf club head constructed to have a large moment of inertia has been proposed. In the Japanese Patent Application Publication No. 2014-410, such a club head is disclosed, wherein the moment of inertia about the Y-axis (vertical axis) extending through the center of gravity of the club head is increased.

In the case of the club head increased in the moment of inertia, even if the ball hitting position is off-centered toward the toe or heel from the sweet spot of the club face, the club head is hard to be rotated around the vertical axis at impact. Thus, such a club head having a large moment of inertia can improve the directionality of the ball hit by an average golfer.

SUMMARY OF THE INVENTION

From the results of study made by the inventor, it was found that the prior iron-type golf club heads have room for improvement to successfully satisfy the flying distance and the directionality of the hit ball at the same time.

It is therefore, an object of the present invention to provide an iron-type golf club head which can improve the flying distance and directionality of a ball hit by an average golfer.

According to the present invention, an iron-type golf club head having a club face provide with a plurality of grooves extending in the toe-heel direction, is characterized by satisfying the following conditions (1)-(4):

(1) the loft angle is not more than 41 degrees, (2) the thickness of the club head is not more than 23 mm, (3) the height of the club face measured along the club face at the position in the toe-heel direction of the most toe-side end of the grooves is not less than 53 mm, (4) in a standard state of the club head, the ratio M/Sh (g sq·cm/mm) of a moment M of inertia (g sq·cm) around a first axis passing through the sweet spot in parallel with the club face and perpendicularly to the grooves, and a sweet spot height Sh (mm) which is the vertical height from the horizontal plane to the sweet spot is not less than 152.

Definitions

In this application, dimensions, positions, directions and the like relating to the club head refer to those under a standard state of the club head unless otherwise noted.

Here, the standard state of the club head is such that the club head is set on a horizontal plane HP so that the axis CL of the club shaft (not shown) is inclined at the specified lie angle alpha while keeping the axis CL on a vertical plane v, and the club face forms the specified loft angle beta. Incidentally, in the case of the club head alone, the center line of the shaft inserting hole can be used instead of the axis CL of the club shaft.

The sweet spot is a point of intersection between the club face 4 and a straight line drawn normally to the club face passing the center G of gravity of the golf club head.

The front-back direction is a direction parallel with the above-mentioned straight line projected on the horizontal plane HP.

The toe-heel direction is a direction parallel with the horizontal plane HP and perpendicular the a front-back direction.

Further, the iron-type golf club head according to the present invention may have the following features (a)-(e):

(a) the sweet spot height Sh is not more than 20 mm;

(b) the moment M of inertia is not less than 3000 (g sq·cm);

(c) the iron-type golf club head includes a head main body having a sole, and a weight member whose specific gravity is larger than the head main body, wherein the head main body is provided in the sole with a channel extending in the toe-heel direction, the weight member is fixed to the channel, the weight member includes a toe-side weight member fitted in a toe-side part of the channel, a heel-side weight member fitted in a heel-side part of the channel, and a sole cover fixed to the channel so as to cover the toe-side weight member and the heel-side weight member;

(d) each of the toe-side weight member and the heel-side weight member has a specific gravity more than that of the sole cover;

(e) the toe-side weight member has a specific gravity more than that of the heel-side weight member.

According to the present invention, therefore, by satisfying the conditions (1)-(4), the iron-type golf club head can achieve both of the increased moment of inertia and the lowered sweet spot height. Thereby, it is possible to significantly improve the flying distance and the directionality of a ball hit by an average golfer.

DESCRIPTION OF THE PREFERRED EMBODIMENTS

Embodiments of the present invention will now be described in detail in conjunction with accompanying drawings.

Figure 1:
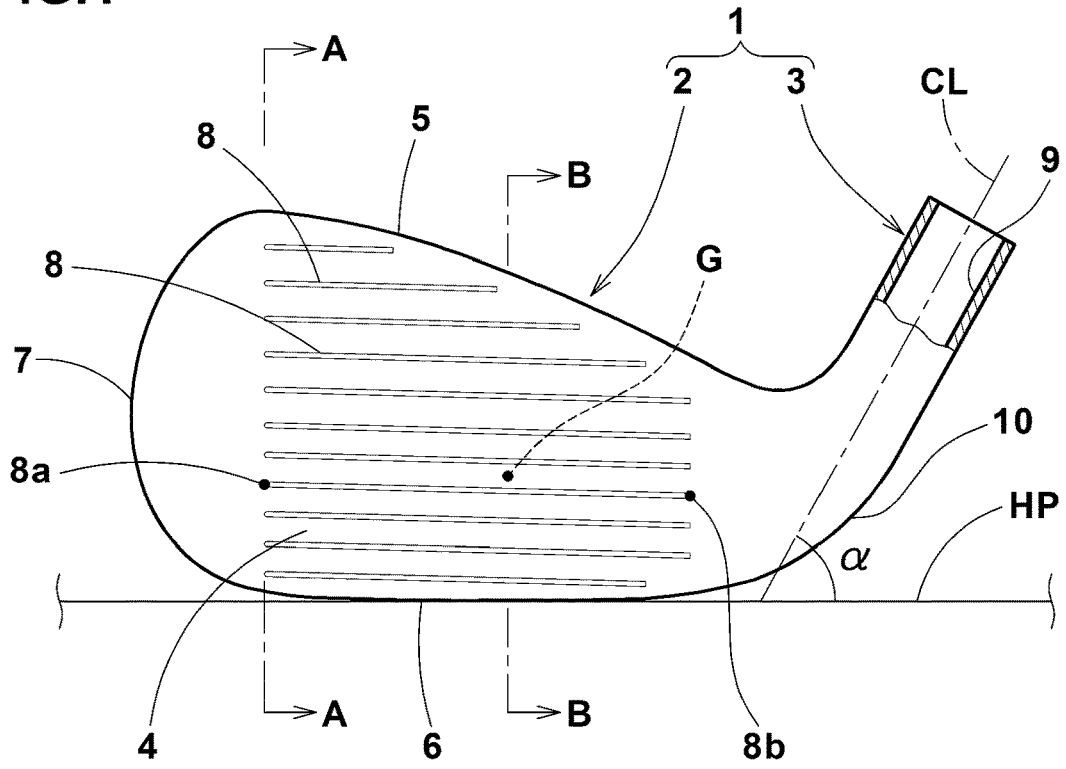
FIG. 1 is a front view of an iron-type golf club head as an embodiment of the present invention under its standard state.
Figure 2:
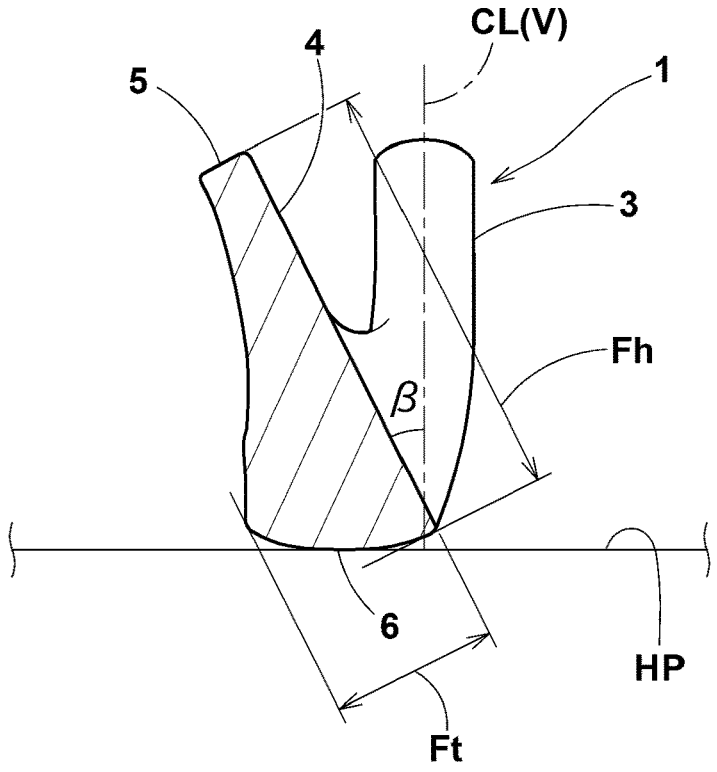
FIG. 2 is a cross sectional view taken along line A-A of FIG. 1.
Figure 3:
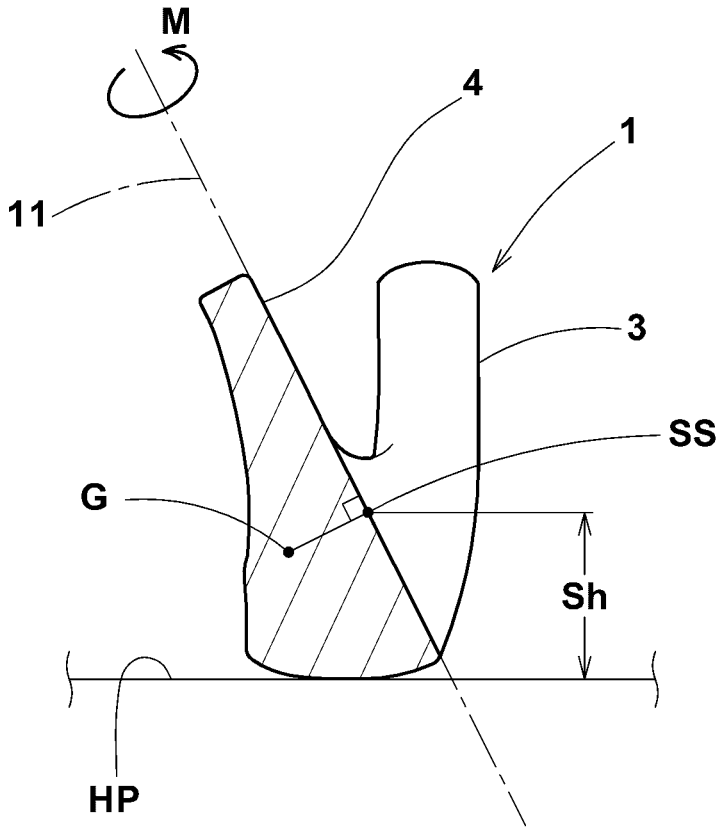
FIG. 3 is a cross sectional view taken along line B-B of FIG. 1.

FIGS. 1-3 show an iron-type golf club head 1 as an embodiment of the present invention under its standard state.

As shown, the club head 1 includes a main portion 2 and a hosel portion 3.

The main portion 2 includes a club face 4, a top 5, a sole 6, a toe 7 and a heel 10.

The club face 4 is a substantially flat surface for hitting a ball. The club face 4 is provided with grooves 8 extending in the toe-heel direction.

Each of the grooves 8 has a small width and a small depth according to the limitations provided in the Golf rules. Under the standard state of the club head 1, each of the grooves 8 extends in the horizontal direction.

The grooves 8 increase the frictional coefficient of the club face 4 to give appropriate spin to the hit ball to improve the flying distance.

Given that a grooved range is a range defined as extending in the toe-heel direction between a position in the toe-heel direction of the most toe-side end 8*a* of the grooves 8, and a position in the toe-heel direction of the most heel-side end 8*b* of the grooves 8, the grooved range has a width in the toe-heel direction determined in view of variations of ball hitting positions of the average golfers, and the grooved range is positioned substantially at the center in the toe-heel direction of the club face 3.

The cross section shown in FIG. 2 is that at the most toe-side end 8*a* of the grooves 8 shown in FIG. 1.

The above-mention top 5 is the upper part of the club head 1 extending backward of the club head from the upper edge of the club face 4.

The sole 6 is the lower part of the club head 1 extending backward of the club head from the lower edge of the club face 4.

The toe 7 is a part which is most distant from the hosel portion 3 and smoothly connects between the top 5 and the sole 6.

The heel 10 is a part on the opposite side of the toe 7 of the club head 1.

The hosel portion 3 is tubular in this example, and has a shaft inserting hole 9 into which a club shaft (not shown) is inserted.

According to the present invention, the club head 1 is characterized by satisfying the following conditions:

(1) a loft angle is not more than 41 degrees, (2) a thickness of the club head is not more than 23 mm, (3) a height of the club face is not less than 53 mm, and (4) the ratio M/Sh (g sq·cm/mm) of a moment M of inertia (g sq·cm) around a first axis passing through the sweet spot SS in parallel with the club face 4 and perpendicularly to the grooves 8 as shown in FIG. 3, and a sweet spot height Sh (mm) which is the vertical height from the horizontal plane HP to the sweet spot SS is not less than 152.

The conditions (1), (2) and (3) are for determining iron-type golf club heads targeted by the present invention. Namely, the iron-type golf club heads satisfying the conditions (1), (2) and (3) include iron-type golf club heads having conventional shapes, but a sand wedge and a pitching wedge for short game and a utility club are not included.

By the conditions (1), club heads having larger loft angles such as a sand-wedge and a pitching wedge are excluded from the target of the present invention. In the case of such club heads, the flying distance will not become an issue.

According to the conventional relationship between the club number and loft angle, the target of the present invention may be up to nine iron club.

Iron-type golf club heads targeted by the present invention are such that importance is put on both of the flying distance and directionality. For example, iron-type golf club heads having loft angles in a range of from 18 to 41 degrees may be targeted.

Further, the conditions (1)-(3) give a limitation to iron-type club heads which are easy to address. In the case of iron-type clubs satisfying the conditions (1)-(3), the trailing edge of the club head may be out of sight of the golfer when properly addressed. This makes it easy for the average golfer to address.

As shown in FIG. 2, the thickness Ft of the club head referred in the condition (2) is a dimension measured from the club face 4 to the rearmost point of the club head in a direction perpendicular to the club face 4 in the vertical cross section of the club head at the most toe-side end 8*a* of the grooves 8.

As the target of the present invention, an iron-type golf club head having a thickness Ft of from 15 to 23 mm is suitable.

As shown in FIG. 2, the height Fh of the club face referred in the condition (3) is a dimension measured along the club face 4 at the most toe-side end 8*a* of the grooves 8.

As the target of the present invention, an iron-type golf club head having a height Fh of from 53 to 63 mm is suitable.

The reason why the thickness Ft and the height Fh of the club face are measured at the most toe-side end 8*a* of the grooves 8 is that the thickness Ft and the height Fh usually become maximum at the above-mentioned position.

FIG. 3 shows a vertical section (perpendicular to the club face) of the club head including the center G of gravity of the club head corresponding to the cross sectional view taken along line B-B of FIG. 1.

The condition (4) defines the ratio M/Sh (g sq·cm/mm) as being not less than 152. The ratio M/Sh (g sq·cm/mm) is that of the moment M of inertia (g sq·cm) around a first axis 11 passing through the sweet spot SS in parallel with the club face 4 and perpendicularly to the grooves 8, and the sweet spot height Sh (mm) which is the vertical height from the horizontal plane HP to the sweet spot SS.

The iron-type golf club head 1 satisfying the conditions (4) can achieve both of a large moment M of inertia and a low sweet spot height Sh.

The value of the moment M of inertia becomes slightly larger than the value of a moment of inertia around a vertical axis passing through the center of gravity of the club head G, and there is a correlation therebetween.

Figure 4:
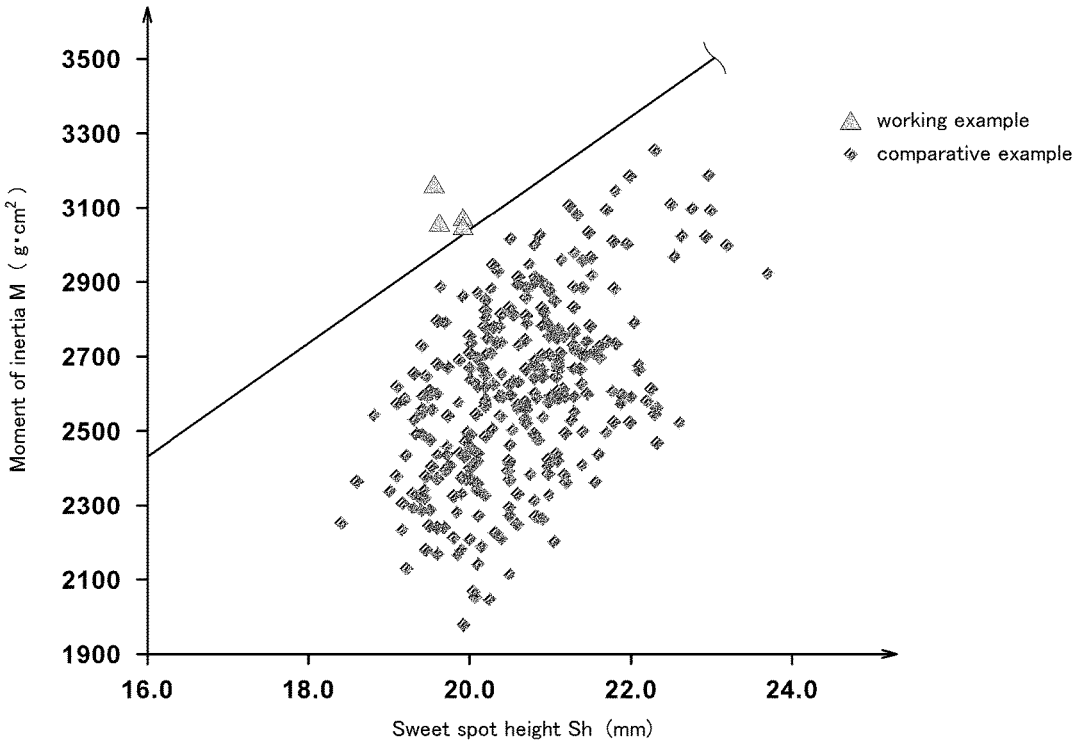
FIG. 4 is a graph showing relationships between the moment of inertia and the sweet spot height of iron-type golf club heads.

FIG. 4 shows relationships between moment M of inertia and sweet spot height Sh of conventional iron-type golf club heads obtained by measurements made by the inventor.

As apparent therefrom, in the case of conventional iron-type golf club heads indicated as comparative examples, if the sweet spot height Sh is low, then the moment M of inertia is small, and if the moment M of inertia is large, then the sweet spot height Sh is also high.

On the other hands, in the case of iron-type golf club heads as embodiments of present invention, the moment M of inertia can be increased while maintaining a low sweet spot height to satisfy the ratio M/Sh of not less than 152. Accordingly, the club head 1 according to the present invention can significantly improve the average golfers' flying distance and directionality.

Preferably, the ratio M/Sh (g sq·cm/mm) is set in a range of not less than 156, more preferably not less than 160.

In so far as the mass of the iron-type golf club head is within a conventional range (for example, 230 to 280 g), it is preferable that the sweet spot height Sh is as low as possible, and the moment M of inertia is as large as possible. Therefore, an upper limit is not given to the ratio M/Sh (g sq·cm/mm).

It is not essential but preferable that the sweet spot height Sh is not more than 21.0 mm, more preferably not more than 20.5 mm, still more preferably not more than 20.0 mm, yet still more preferably not more than 19.8 mm.

It is not essential but preferable that the moment M of inertia is not less than 2900 g sq·cm, more preferably not less than 2950 g sq·cm, still more preferably not less than 3000 g sq·cm.

Figure 5:
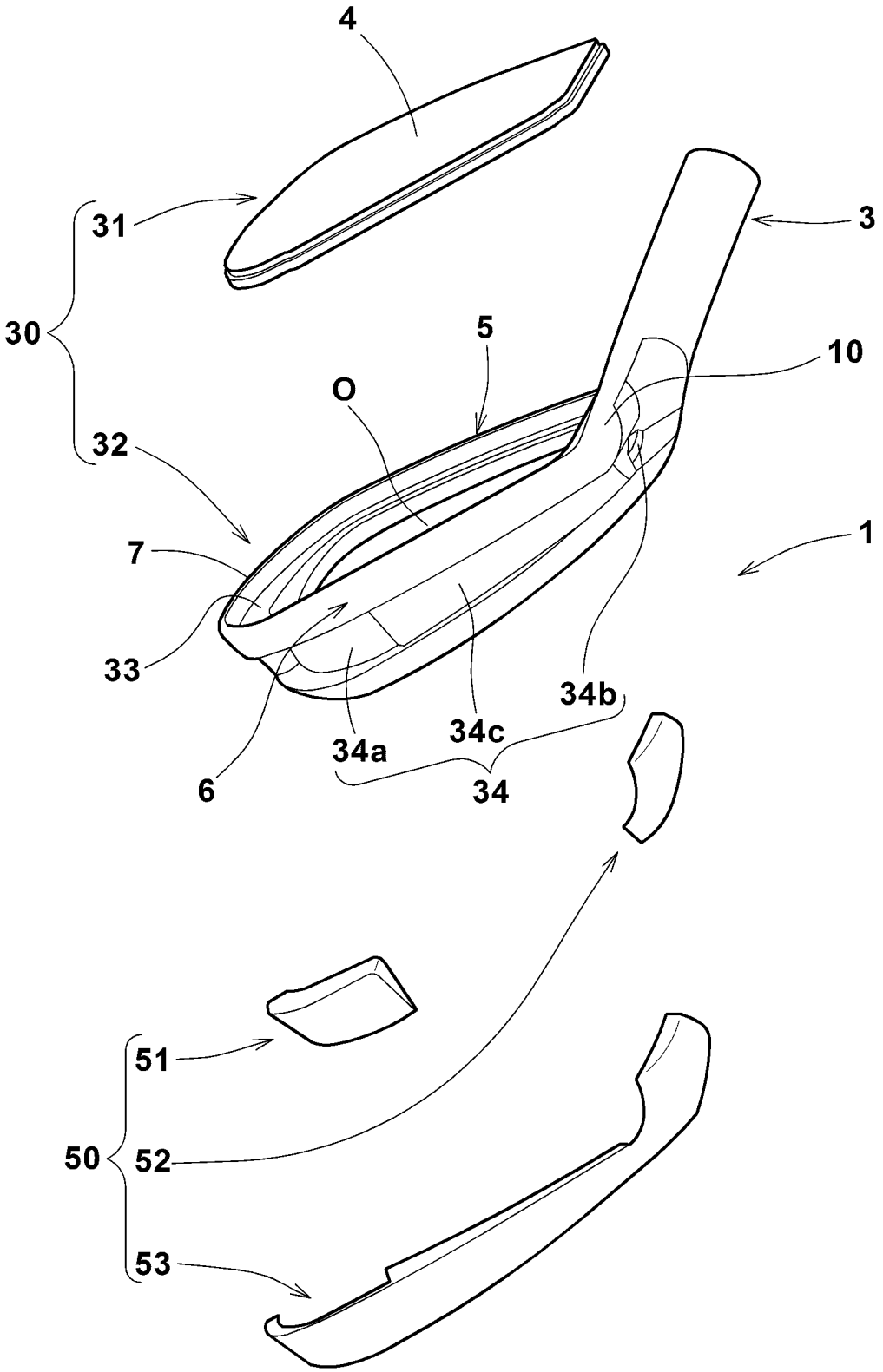
FIG. 5 is an exploded perspective view of an iron-type golf club head as a working Example.

FIG. 5 shows an example of the structure of the club head 1 especially designed to satisfy the limitation of the ratio M/Sh.

As shown, the structural members of the club head 1 include a head main body 30 and a weight member 50.

Preferably, the head main body 30 includes a face plate 31 forming a major part of the club face 4, and a face plate receiving frame 32 on which the face plate 31 is mounted.

The face plate 31 is made of a material having a specific gravity which is smallest in the structural members of the club head 1. For the face plate 31, a metal material whose specific gravity is not more than 4.5 is preferably used. Especially, the use of a titanium alloy is preferred.

The face plate receiving frame 32 is provided with a though hole O penetrating in the front-back direction of the club head, while being surrounded by the top 5, the sole 6, toe 7 and the heel 10.

The face plate receiving frame 32 is provided around the hole O with a club face mount portion 33 to which a peripheral part of the face plate 31 is fixed.

By the face plate 31 fixed to the club face mount portion 33, the hole O of the face plate receiving frame 32 is closed.

The face plate receiving frame 32 integrally includes the hosel portion 3.

Preferably, the face plate receiving frame 32 is made of an iron-based alloy having strength and good workability. Preferably, stainless steel or carbon steel having a specific gravity of not less than 7.5 can be used. Such face plate receiving frame 32 is helps to increase the moment M of inertia.

Figure 6:
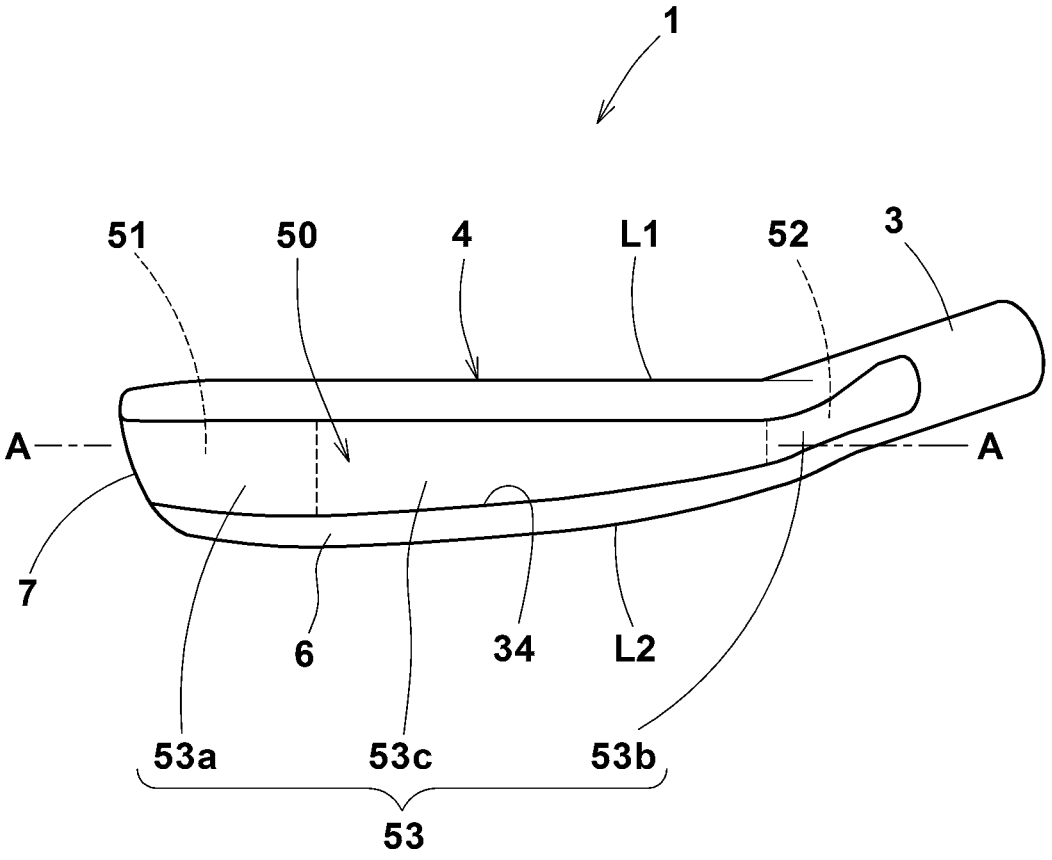
FIG. 6 is a bottom view of the iron-type golf club head shown in FIG. 5 under its standard state.

FIG. 6 is a bottom view of the club head 1 under the standard state. As shown, the head main body 30 is provided in the sole 6 with a channel 34 extending in the toe-heel direction.

The channel 34 extends in the sole 6 along the toe-heel direction as shown in FIG. 5 and FIG. 6. In this embodiment, the channel 34 is formed over the substantially entire extent of the sole 6 in the toe-heel direction. The toe-side end and the heel-side end of the channel 34 reach to the toe 7 and the hosel portion 3, respectively.

As shown in FIG. 6, the channel 34 has a width in the front-back direction of the club head which is within the width between the leading edge L1 and the trailing edge L2.

Figure 7:
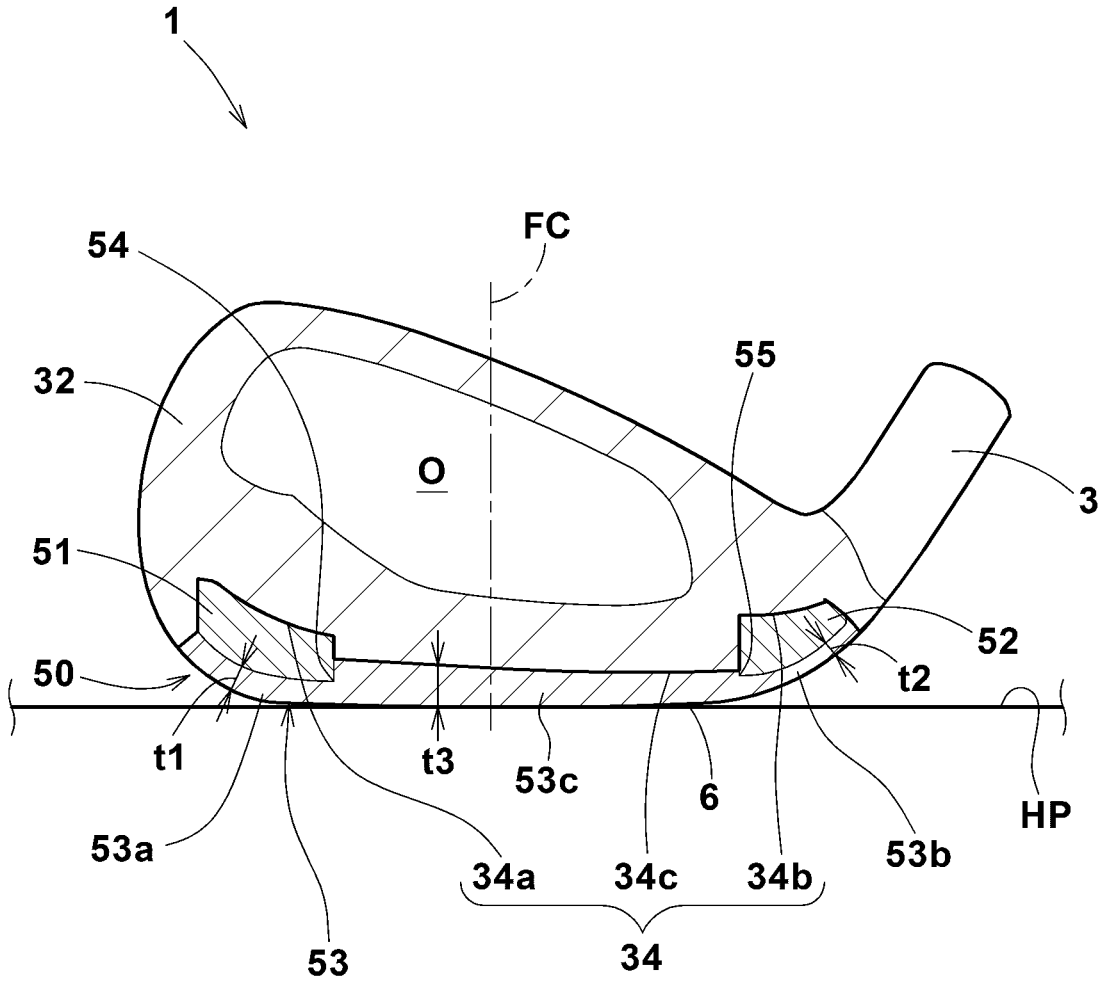
FIG. 7 is a cross sectional view taken along line A-A of FIG. 6.

FIG. 7 is a cross sectional view taken along line A-A of FIG. 6.

The channel 34 comprises a toe-side channel portion 34*a*, a heel-side channel portion 34*b*, and a middle channel portion 34*c* extending therebetween as shown in FIG. 5 and FIG. 7. The toe-side channel portion 34*a* and the heel-side channel portion 34*b* dent from the outer surface of the sole 6 more than the middle channel portion 34*c*. In other words, the bottoms of the toe-side channel portion 34*a* and the heel-side channel portion 34*b* are positioned more upward away from the horizontal plane HP.

The weight member 50 is fixed to the channel 34.

In this embodiment, the weight member 50 includes three separate members: a toe-side weight member 51, a heel-side weight member 52 and a sole cover 53.

The weight members 51, 52 and 53 each have a specific gravity more than the specific gravity of the head main body 30 (namely, the face plate 31 and the face plate receiving frame 32).

It is preferable that the specific gravity of each weight member 50 (51, 52 and 53) is not less than 9.0.

The toe-side weight member 51 is disposed on the toe-side of the center of the club face FC in order to concentrate the mass at a toe-side part of the club head 1.

The center of the club face FC means the center in the toe-heel direction of the grooved range.

The toe-side weight member 51 has an outer shape such that the toe-side weight member 51 fits into the toe-side channel portion 34*a* without a space therebetween in substance. Thereby, movements of the toe-side weight member 51 in the upper direction, the front-back direction and the toe-heel direction of the club head are restrained by being inserted in the toe-side channel portion 34*a*.

The under surface of the toe-side weight member 51 is positioned above the outer surface of the sole 6 so as not to form the outer surface of the sole 6.

It is not essential but preferable that the toe-side weight member 51 is curved upward toward the toe-side. Thereby, it is possible to effectively actualize the lowering of position of the center of gravity and a mass distribution toward a toe-side upper part.

The heel-side weight member 52 is disposed on the heel-side of the center of the club face FC in order to concentrate the mass at a heel-side part of the club head 1.

The heel-side weight member 52 has an outer shape such that the heel-side weight member 52 fits into the heel-side channel portion 34*b* without a space therebetween in substance. Thereby, movements of the heel-side weight member 52 in the upper direction, the front-back direction and the toe-heel direction of the club head are restrained by being inserted in the heel-side channel portion 34*b*.

The under surface of the heel-side weight member 52 is positioned above the outer surface of the sole 6 so as not to form the outer surface of the sole 6.

It is not essential but preferable that the heel-side weight member 52 is curved upward toward the heel-side. Thereby, it is possible to effectively actualize the lowering of position of the center of gravity and a mass distribution toward a heel-side upper part.

The sole cover 53 extends in the toe-heel direction across the center of the club face FC. In this embodiment, the sole cover 53 extends in the toe-heel direction over the entire length of the channel 34. Thereby, the sole cover 53 in this embodiment completely covers the toe-side weight member 51 and the heel-side weight member 52 from the under side (sole side).

Preferably, each of the toe-side weight member 51 and the heel-side weight member 52 has a specific gravity more than that of the sole cover 53. Thereby, it is possible to achieve the above-described lowered center of gravity of the club head G and increased moment M of inertia at the same time.

It is especially effective for effectively increasing the moment M of inertia while achieving the lowered center of gravity, to configure the sole cover 53 to have a specific gravity more than that of the head main body 30, and less than those of the toe-side weight member 51 and the heel-side weight member 52. Further, since the hosel portion 3 provides a relatively large mass in a heel side part of the club head 1, in order to balance therewith, the toe-side weight member 51 preferably has a specific gravity more than that of the heel-side weight member 52.

In order to allow the ratio M/Sh in a preferable range, it is desirable that the specific gravity of the toe-side weight member 51 is more than 14, preferably not less than 15, more preferably not less than 16, the specific gravity of the heel-side weight member 52 is more than 10, preferably not less than 11, more preferably not less than 13, and the specific gravity of the sole cover 53 is not more than 9 and not less than 10.

In this embodiment, the weight members 51, 52 and 53 are each made of a tungsten-nickel-iron alloy containing w, Ni and Fe. The specific gravity of each of the weight members 51, 52 and 53 can be adjusted by mainly changing the content of tungsten W having a large specific gravity.

In this embodiment, the alloy materials of the toe-side weight member 51 and the heel-side weight member 52 each has a content of tungsten w more than that of the alloy material of the sole cover 53 so as to have a specific gravity more than that of the sole cover 53.

The weldability of the tungsten-nickel-iron alloy with the iron-based alloy of the head main body 30 is decreased with the increase in the content of w. Accordingly, if a tungsten-nickel-iron alloy having a high tungsten content is used as the toe-side weight member 51 and the heel-side weight member 52, it becomes difficult to make a strong weld joint between the head main body 30 of the iron-based alloy and the toe-side weight member 51 and the heel-side weight member 52.

However, the sole cover 53 whose tungsten content is lower than the toe-side weight member 51 and the heel-side weight member 52 has a better weldability with the iron-based alloy than those of the weight members 51 and 52.

Therefore, in this embodiment, the sole cover 53 is fixed to the head main body 30 (face plate receiving frame 32) by welding. But, the toe-side weight member 51 and the heel-side weight member 52 are not welded to the face plate receiving frame 32 and the sole cover 53. Accordingly, the toe-side weight member 51 and the heel-side weight member 52 are fixedly held in an interior space of the club head defined by the head main body 30 and the sole cover 53, essentially by being closely fitted therewith.

When fixing the three weight members 51-53 to the head main body 30, the toe-side weight member 51 and the heel-side weight member 52 can be easily located at their proper positions by fitting these into the toe-side channel portion 34*a* and the heel-side channel portion 34*b*.

Then, by welding only the sole cover 53 to the channel 34 of the head main body 30, the weight members 51-53 can be fixed to the head main body 30.

In the club head 1 in this embodiment, accordingly, the weight members can be fixed to the head main body 30 with a simple process.

Preferably, the sole cover 53 comprises a toe-side thin portion 53*a*, a heel-side thin portion 53*b* and an in-between thick portion 53*c* extending therebetween as shown in FIG. 7.

The toe-side thin portion 53*a* is a portion located beneath the toe-side weight member 51.

The heel-side thin portion 53*b* is a portion located beneath the heel-side weight member 52.

It is desirable that the toe-side thin portion 53*a* and the heel-side thin portion 53*b* are made as thin as possible. Thereby, while giving a large mass to the toe side and heel side, the toe-side weight member 51 and the heel-side weight member 52 can be positioned on the further lower side (toward the outer surface of the sole 6). Therefore, the club head can be provided with the further lowered center of gravity.

Preferably, the thickness t1 of the toe-side thin portion 53*a* and the thickness t2 of the heel-side thin portion 53*b* are set in a range of not more than 3.0 mm, more preferably not more than 2.5 mm, still more preferably not more than 2.0 mm.

The thickness t3 of the in-between thick portion 53*c* is more than the thickness t1 of the toe-side thin portion 53*a* and the thickness t2 of the heel-side thin portion 53*b*.

Due to such thickness variation, the upper surface of the sole cover 53 has a step 54 at the boundary between the in-between thick portion 53*c* and the toe-side thin portion 53*a*, and a step 55 at the boundary between the in-between thick portion 53*c* and heel-side thin portion 53*b*.

The steps 54 and 55 can closely contact with the toe-side weight member 51 and the heel-side weight member 52 disposed in the channel 34 without being welded, therefore, their positions in the toe-heel direction are more certainly fixed. Thereby, unpleasant hit feeing and sound can be prevented.

Preferably, the thickness t3 of the in-between thick portion 53*c* is gradually increased towards the toe. Such sole cover 53 helps to increase a mass distribution toward the toe while achieving the lowering of position of the center of gravity. This helps to further increase the ratio M/Sh (g sq·cm/mm).

Figure 8:
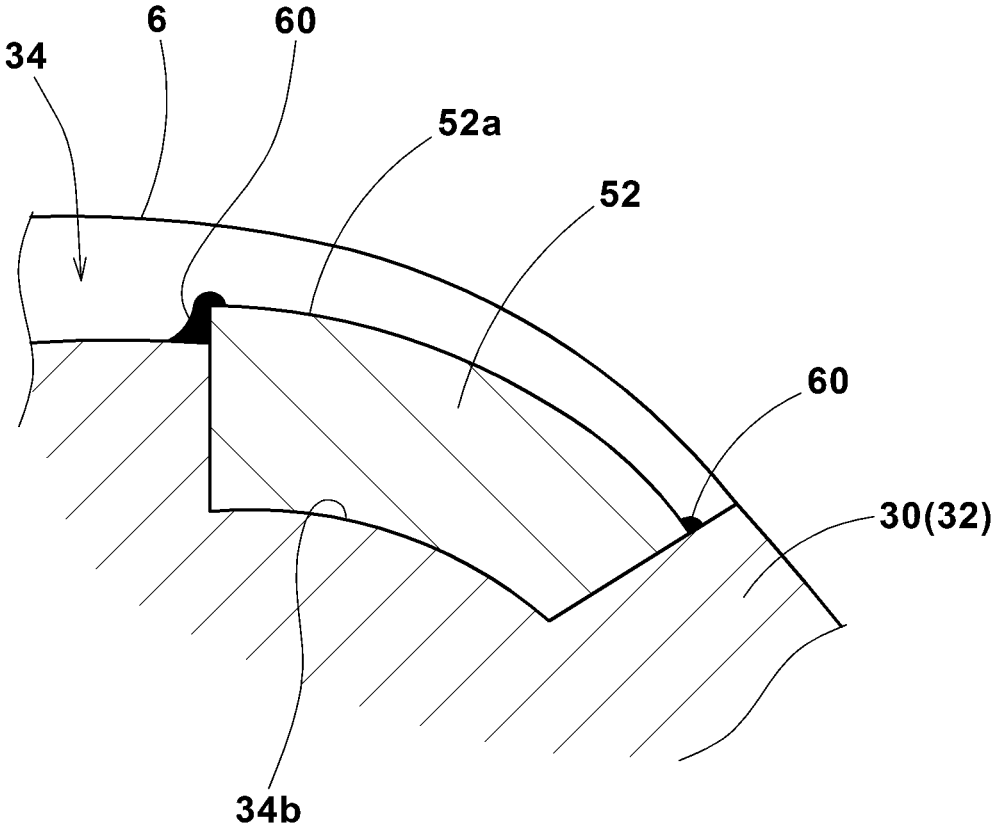
FIG. 8 is a cross sectional view showing a modification of the heel-side part of the club head shown in FIG. 7.

FIG. 8 shows a modification of the heel-side part shown in FIG. 7, wherein the heel-side part is shown bottom-up.

In this example, in order to assure the positioning of the heel-side weight member 52, a temporary fixing part 60 is used.

The temporary fixing part 60 is formed by solidifying a molten metal material. Preferably, the molten metal material is the same metal material as that of the head main body 30 (in particular, the face plate receiving frame 32) or a metal material whose major component is the same as the major component the head main body 30 (in particular, the face plate receiving frame 32).

After the heel-side weight member 52 is fitted in the heel-side channel portion 34*b*, for example, molten stainless steel as the temporary fixing part 60 is attached to spots arranged along the boundary between the heel-side weight member 52 and the heel-side channel portion 34*b*.

Preferably, the temporary fixing part is bent into a hook as shown in FIG. 8 so that a part of the molten metal covers a sole-side surface 52*a* of the heel-side weight member 52. Such molten metal is not for serving for metallic binding with the heel-side weight member 52. But, it exhibits continuous metallic binding with the head main body 30, therefore, the heel-side weight member can be surely prevented from moving toward the sole.

Although not shown, it is of course possible to apply such temporary fixing part 60 to the toe-side weight member 51 in the same manner as described above.

While detailed description has been made of preferable embodiments of the present invention, the present invention can be embodied in various forms without being limited to the illustrated embodiment Comparison Tests Based on the structure and shape shown in FIGS. 5 to 7, club heads as working examples were experimentally manufactured and measured for the moment M of inertia and the sweet spot height Sh.

Figure 9:
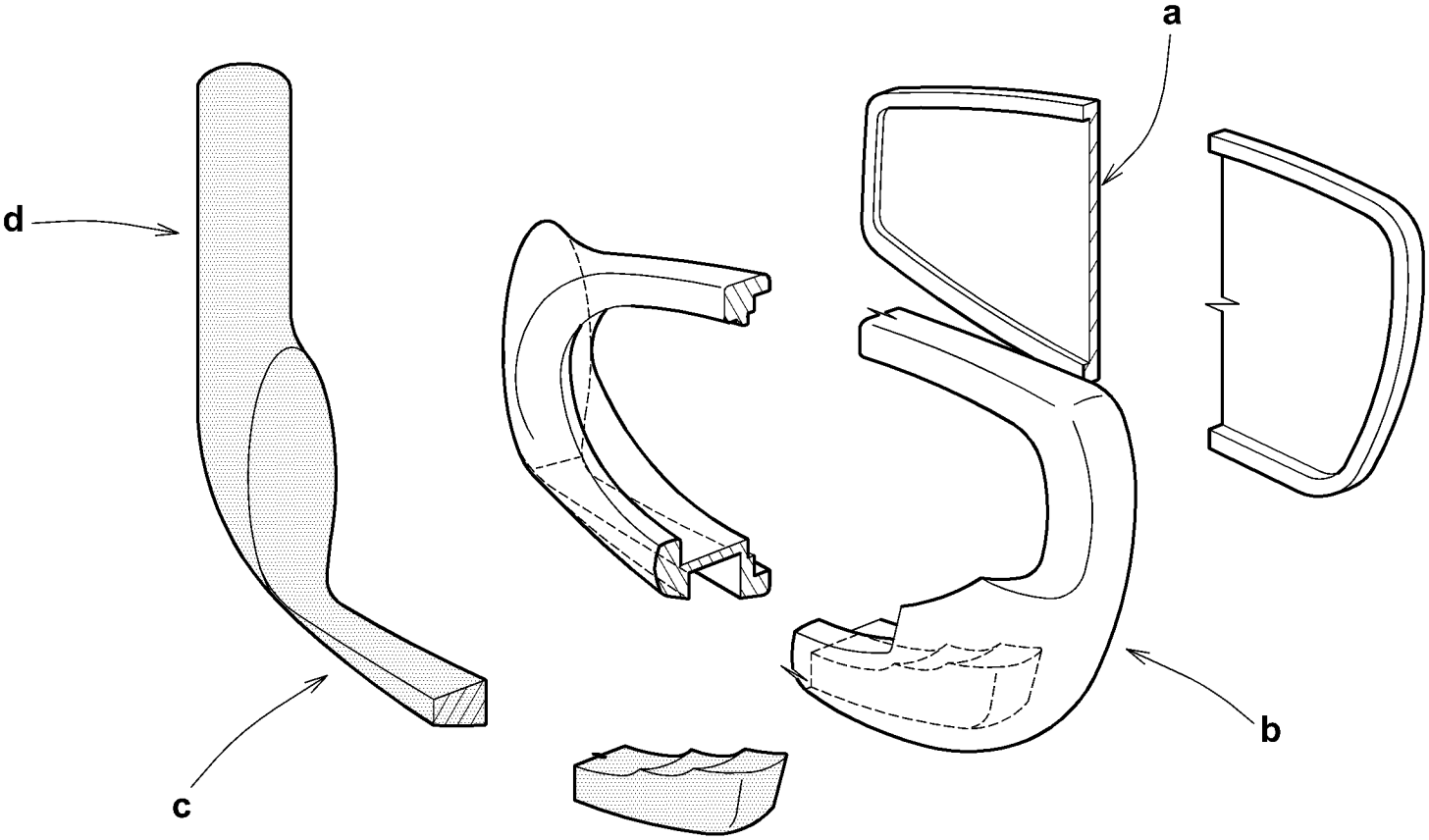
FIG. 9 is an exploded perspective view of an iron-type golf club head as Comparative example.

Further, a club head as comparative example made up of a face plate (a), a face plate receiving frame (b) and a weight member (c) integrated with a hosel portion (d) as shown in FIG. 9 was also manufactured and measured for the moment M of inertia and the sweet spot height Sh. The weight member (c) integrated with the hosel portion (d) is described in the US Patent Application Publication No. 2015-0038263A1.

Specifications of these club heads are as follows.

<Common Specifications> club head: for six iron club
lie angle alpha: 61.5 degrees
loft angle beta: 27 degrees Working Example 1

FIG. 5 weight members' materials: tungsten-nickel-iron alloys
toe-side weight member's specific gravity: 16
heel-side weight member's specific gravity: 14
sole cover's specific gravity: 9.5
face plate's material: titanium alloy (specific gravity: 4.4)
face plate receiving frame's material: SuS630
specific gravity: 7.8

Comparative Example 1

FIG. 9 weight member's material: tungsten-nickel-iron alloy
specific gravity: 9.5
face plate's material: titanium alloy (specific gravity: 4.4)
face plate receiving frame's material: SuS630
specific gravity: 7.8

<Sweet Spot Height>

As shown in FIG. 3, the height (sh) from the horizontal plane to the sweet spot under the standard state of the club head was measured.

<Moment of Inertia>

The moment M of inertia around the first axis 11 under the standard state of the club head as shown in FIG. 3 was measured with a moment of inertia measuring instrument (MODEL NO. 005-002) manufactured by INERTIA DYNAMICS Inc.

<Flying Distance and Directionality>

The club heads were attached to identical FRP shafts to make #6 iron clubs. Then, using the #6 iron clubs, each of ten average golfers having average scores ranging from 85 to 100 hit golf balls lying on lawn twenty times per club to obtain the flying distance of the struck ball and the distance of the point of fall of the struck ball from the target trajectory was measured in each shot regardless of slice or hook. For each of the clubs, two hundred measurements obtained from the ten golfers were averaged, and the averaged values are shown in Table 1.

TABLE 1

| Head | Comparative example 1 | Working example 1 | Working example 2 | Working example 3 | Working example 4 |
|---|---|---|---|---|---|
| mass of club head (g) | 257 | 257 | 257 | 257 | 257 |
| loft angle (deg.) | 27 | 27 | 27 | 27 | 27 |
| height Fh of club face (mm) | 56.6 | 56.6 | 56.6 | 56.6 | 56.6 |
| thickness Ft club face (mm) | 22.8 | 22.8 | 22.8 | 22.8 | 22.8 |
| moment M of inertia (g sq · cm) | 2969 | 3180 | 3052 | 3080 | 3040 |
| sweet spot height Sh (mm) | 22 | 19.5 | 19.7 | 20 | 20 |
| ratio M/Sh (g sq · cm/mm) | 135 | 163 | 155 | 154 | 152 |
| specific gravity | | | | | |
| toe-side weight member | — | 16.0 | 10 | 10 | 9.5 |
| heel-side weight member | — | 14.0 | 9.5 | 10 | 9.5 |
| sole cover | — | 9.5 | 9.5 | 7.8 | 7.8 |
| face plate | 4.4 | 4.4 | 4.4 | 4.4 | 4.4 |
| face receiving frame | 7.8 | 7.8 | 7.8 | 7.8 | 7.8 |
| flying distance (m) | 130 | 133.5 | 132.6 | 132.1 | 131.7 |
| directionality of the hit ball (m) | 4.5 | 1.2 | 3.1 | 2.6 | 3.3 |

From the test results, it was confirmed that working examples were increased in the ratio M/Sh and improved in the average golfers' flying distance and directionality.

REFERENCE SIGNS LIST

1 iron-type golf club head
2 main portion
3 hosel portion
4 club face
5 top
6 sole

7 toe
11 first axis
30 head main body
31 face plate
32 face plate receiving frame
34 channel
34*a* toe-side channel portion
34*b* heel-side channel portion
34*c* middle channel portion
50 weight member
51 toe-side weight member
52 heel-side weight member
53 sole cover

The invention claimed is:

1. A golf club head for an iron club having a loft angle of from 18 to 41 degrees having a back cavity, the golf club head comprising:

a face plate forming a club face for hitting a ball and provided with parallel grooves extending in a toe-heel direction of the club head; and a face plate receiving frame on which the face plate is mounted, wherein:

the face plate receiving frame is provided with a through-hole penetrating in a front-back direction of the club head to be surround by a top, a sole, a toe and a heel of the club head, the face plate receiving frame integrally includes a hosel attached to a golf club shaft, the face plate receiving frame is provided around the through-hole with a mount portion to which a peripheral part of the face plate is fixed, the through-hole is closed by the face plate fixed to the mount portion and forms said back cavity opened backward of the club head, the face plate receiving frame is provided with a channel extending continually in a toe-heel direction of the club head and having an opening within a width in the front-back direction of the club head between a leading edge (L1) and a trailing edge (L2) of the sole, a toe-side weight member and a heel-side weight member are disposed in a toe-side portion and a heel-side portion of the channel, respectively, at a distance from each other in the toe-heel direction of the club head so that the toe-side weight member is positioned on the toe-side of a center of the club face, and the heel-side weight member is positioned on the heel-side of the center of the club face, said opening of the channel is closed by a separate sole cover to hold the toe-side weight member and the heel-side weight member within the channel, the face plate is made of a metal material having a specific gravity of not more than 4.5, the face plate receiving frame has a specific gravity of not less than 7.5, the toe-side weight member and the heel-side weight member are larger in specific gravity than the face plate receiving frame, the specific gravity of the toe-side weight member is more than 14, and the specific gravity of the heel-side weight member is more than 10, the sole cover is smaller in specific gravity than the toe-side weight member and the heel-side weight member, and the specific gravity of the sole cover is not less than 9 and not more than 10 a maximum thickness of the club head is between 15 mm and 23 mm, when measured under a standard state of the club head, from the club face to a rearmost point of the club head in a direction perpendicular to the club face in a vertical cross section of the club head taken at a most toe-side end of the parallel grooves, a height (Fh) of the club face is between 53 mm and 63 mm, when measured under the standard state of the club head, along the club face at the position of the most toe-side end of the parallel grooves, and the standard state is a state of the club head set on a horizontal plane at a lie angle and loft angle specified for the club head, a ratio M/Sh (g sq·cm/mm) of a moment M of inertia (g sq·cm) around a first axis passing through a sweet spot and extending in parallel with the club face and perpendicular to the grooves, and a sweet spot height Sh (mm), which is the vertical height measured under the standard state of the club head from the horizontal plane to the sweet spot, is not less than 152, the sweet spot is a point of intersection between the club face and a straight line drawn normally to the club face passing the center of gravity of the club head, the front-back direction is a direction parallel with said straight line projected on the horizontal plane, the toe-heel direction is a direction parallel with the horizontal plane and perpendicular to the front-back direction, the sweet spot height Sh is less than or equal to 20 mm, and the moment M of inertia is greater than 3000 g sq·cm.

2. The golf club head according to claim 1, wherein the channel extends over a substantially entire extent of the sole in the toe-heel direction, and wherein the toe-side weight member is fitted in the toe-side portion of the channel, and the heel-side weight member is fitted in the heel-side portion of the channel.

3. The golf club head according to claim 1, wherein the specific gravity of the toe-side weight member is more than that of the heel-side weight member.

4. The golf club head according to claim 1, wherein the sole cover is welded to the face plate receiving frame whereas the toe-side weight member and the heel-side weight member are not welded to the face plate receiving frame and the sole cover, the channel has a part into which the toe-side weight member is fitted, and a part into which the heel-side weight member is fitted, and the sole cover has a recess to which the toe-side weight member is fitted, and a recess to which the heel-side weight member is fitted.

5. The golf club head according to claim 4, wherein the face plate is made of a titanium alloy, the face plate receiving frame is made of a stainless steel, the toe-side weight member is made of a tungsten-nickel-iron alloy, and the heel-side weight member is made of a tungsten-nickel-iron alloy.

* * * * *